US009995041B2

(12) United States Patent
Shoham

(10) Patent No.: US 9,995,041 B2
(45) Date of Patent: Jun. 12, 2018

(54) CONNECTING ELEMENT FOR CORRUGATED PANELS AND METHOD OF USE OF SAME

(71) Applicant: Palram Industries (1990) Ltd., Kibbutz Ramat Yohanan (IL)

(72) Inventor: Boaz Shoham, Kibbutz Ramat Yohanan (IL)

(73) Assignee: PALRAM INDUSTRIES (1990) LTD, Kibbutz Ramat Yohanan (IL)

( * ) Notice: Subject to any disclaimer, the term of this patent is extended or adjusted under 35 U.S.C. 154(b) by 0 days. days.

(21) Appl. No.: 15/319,030

(22) PCT Filed: Jun. 17, 2015

(86) PCT No.: PCT/IL2015/050612
§ 371 (c)(1),
(2) Date: Dec. 15, 2016

(87) PCT Pub. No.: WO2015/193893
PCT Pub. Date: Dec. 23, 2015

(65) Prior Publication Data

US 2017/0138052 A1 May 18, 2017

Related U.S. Application Data

(60) Provisional application No. 62/013,022, filed on Jun. 17, 2014, provisional application No. 62/022,787, filed on Jul. 10, 2014.

(51) Int. Cl.
*E04D 3/365* (2006.01)
*E04D 3/30* (2006.01)
*E04D 3/28* (2006.01)

(52) U.S. Cl.
CPC ..... *E04D 3/365* (2013.01); *E04D 3/28* (2013.01); *E04D 3/30* (2013.01)

(58) Field of Classification Search
CPC ..... E04D 3/36; E04D 3/365; E04D 3/30
See application file for complete search history.

(56) References Cited

U.S. PATENT DOCUMENTS 1,661,251 A * 3/1928 Frey ..... E04D 3/365 52/489.1
1,775,778 A * 9/1930 Papalas ..... E04D 3/365 52/521

(Continued)

FOREIGN PATENT DOCUMENTS

DE 10043111 A1 * 12/2001 ..... E04D 3/365
JP 2008013985 1/2008

(Continued)

OTHER PUBLICATIONS

International Search Report of Application No. PCT/IL2015/050612 dated Oct. 19, 2015.

(Continued)

*Primary Examiner* — Babajide A Demuren
(74) *Attorney, Agent, or Firm* — Pearl Cohen Zedek Latzer Baratz LLP

(57) ABSTRACT

A connecting means for connecting two corrugated sheets firmly to each other is made of a thin metal sheet folded into two portions; one portion is shorter than the other portion and is parallel to one part of the second portion, forming a gap between the folded portions that fits the thickness of the corrugated sheets. A threaded hole is made in the other part of the second portion of the connecting means adapted to accept a fastening screw. The connecting means may be placed over an edge of one corrugated sheet, another corrugated sheet is placed over the one corrugated sheet and a fastening screw is inserted through concentric holes made in the two corrugated sheets and is firmly fastened in the threaded hole.

4 Claims, 6 Drawing Sheets

(56) References Cited

U.S. PATENT DOCUMENTS

| | | | | | |
|---|---|---|---|---|---|
| 1,775,780 | A * | 9/1930 | Papalas | E04D 3/36 | 52/489.1 |
| 2,325,124 | A * | 7/1943 | Gardner | E04D 3/365 | 52/521 |
| 2,787,349 | A * | 4/1957 | Kretschmar | E04D 3/365 | 52/521 |
| 3,143,828 | A | 8/1964 | Bowman | | |
| 4,570,404 | A | 2/1986 | Knudson | | |
| 5,533,313 | A | 7/1996 | Pike | | |
| 5,557,903 | A * | 9/1996 | Haddock | E04D 3/3607 | 52/408 |

FOREIGN PATENT DOCUMENTS

| | | | | |
|---|---|---|---|---|
| JP | 2010265682 | | 11/2010 | |
| WO | WO 9301376 | A1 * | 1/1993 | E04D 3/36 |
| WO | WO 2016109871 | A1 * | 7/2016 | E04D 3/3607 |

OTHER PUBLICATIONS

Search Report of European Application No. 15 80 9403 dated Dec. 19, 2017.

* cited by examiner

CONNECTING ELEMENT FOR CORRUGATED PANELS AND METHOD OF USE OF SAME

CROSS-REFERENCE TO RELATED APPLICATIONS

This application is a National Phase Application of PCT International Application No. PCT/IL2015/050612, International Filing Date Jun. 17, 2015, entitled "Connecting Element for Corrugated Panels and Method of Use of Same", published as WO 2015/193893 on Dec. 23, 2015 and claiming the benefit of U.S. Provisional Patent Application No. 62/013,022, filed Jun. 17, 2014 and U.S. Provisional Patent Application No. 62/022,787, filed Jul. 10, 2014, all of which are hereby incorporated by reference.

BACKGROUND OF THE INVENTION

Corrugated flexible plastic sheets are widely used in buildings for roofing or otherwise covering portions of the building to protect from ambient effects, such as sun radiation, rain, dust, etc. In some cases, illumination of the interior part of the building by natural light is required, e.g. greenhouses or industrial facilities roof or walls which require natural lighting during daylight times. In such cases, the corrugated sheets may have certain levels of transparency, as may be desired.

The main benefits of assembling transparent corrugated plastic sheets is illumination energy saving. To further reduce the energy costs of such buildings, the connection between each transparent corrugated plastic sheets and its neighboring sheets (either transparent or not) should be sealed to prevent various environmental effects, for example, penetration of rain into the building which is covered by the corrugated sheets, heat leakage due to temperature differences, penetration of wind and/or dust, and the like. The corrugation of the plastic sheets provides the sheets with the necessary strength while maintaining the sheets' flexibility in both directions of the sheet—parallel to the corrugation waves (which is easier to accomplish) and perpendicular to that direction.

Typically, roofing (or otherwise covering a large area) with corrugated sheets involves a certain overlap of one sheet over or under its neighboring sheet. Since sheets with identical corrugation profile are used for covering a certain area, typically a peak of a corrugation wave at the very end of that sheet is used to overlap (or under lap) a similar wave peak of the neighboring sheet. FIG. 1A is an isometric view and FIG. 1B is a side view of an elongated assembly of bottom profile 12B that fits the concaved side 13 of the bottom sheet 10A so as to touch it along the peak 13A of the corrugation wave of corrugated sheet 10A. Bottom profile 12B provides counter-base for threading connecting bolts/screws 14 that are inserted from above through a top elongated fixing element 12A, through top sheet 10B and through bottom sheet 10A, and are then threaded into the bottom elongated element 12B thus clamping corrugated sheets 10A and 10B to each—other along overlapping peaks of waves of the corrugations.

Such connecting elongated elements are typically designed for particular installations having a particular length that corresponds to the particular lengths of the corrugated sheets used in the installation. Such way of connecting elongated elements is relatively expensive and do not provide flexibility of use when it is required to cover an area using corrugated sheets of length different than the standard length because there is a need to match the length of the connecting elements to that of the corrugated sheets. This increases the overall cost of the building both in materials and in installation time. Furthermore, at least two workers are needed in order to assemble the connecting elongated elements, one on each side of the corrugated sheet. This solution involves complex installation and requires specific adaptation of elements in cases where the length of the sheets is different than the common length. Additionally, adapting this solution for installations where the covered plane is not flat, but rather concaved or convex with the curved line residing in a plane perpendicular to the plane of the roof and parallel to the corrugated peak line, requires on-site adaptation of the elongated elements to that curvature.

As seen in FIG. 1C, another solution known in the art for fastening corrugated sheets to each other is self-grip lap fastener, which is a flat thin metal piece in which a tread is pre-prepared, having several claws which are made to punch into the external (usually bottom) side of one of the corrugated overlapping sheets and accept a screw that is inserted through the top sheet and the bottom sheet and screwed into its thread. This solution suffers of a main disadvantage—when installed, the self-grip fastener punches through the sheet to which it is attached, thus creating cracks that later expend and lead to leakage problems.

FIGS. 1D and 1E depict another solution known in the art for fastening corrugated sheets to each other using rubber stitching fastener with internal threading. When in loose position it has a cylindrical main body that may be inserted through overlapping through-holes in the overlapping top and bottom corrugated sheets and then by screwing the bolt the rubber element (or EPDM element) is pressed and expends its diameter so as to tighten the sheets to each other. This solution is relatively expensive and involves installation complexity.

SUMMARY OF THE INVENTION

A connecting element for connecting corrugated sheets to each other is disclosed, the connecting element may comprise a thin metal sheet comprising a first portion and a second portion longer than the first portion, the first and second portions are folded with respect each other along a folding line so that the first portion is substantially parallel to and overlapping a first part of the second portion, the second portion is formed according to a profile of said corrugated sheet. A threaded hole is formed in the second portion at a second part that is not parallel to the first portion.

The connecting element may further comprise at least one strengthening submergence formed in said second part of said second portion.

The connecting element may have the second part formed to have a wavy profile or an angular profile.

An assembly of corrugated sheets connected to each other is disclosed comprising at least two corrugated sheets having similar profile of corrugations and at least one connecting element which comprises a first portion and a second portion longer than the first portion, the first and second portions are folded with respect each other along a folding line so that the first portion is substantially parallel to and overlapping a first part of the second portion, the second portion is formed according to a profile of said corrugated sheet, wherein a threaded hole is formed in the second portion at a second part not parallel to the first portion; a fastening screw for each of said at least one connecting element, and a sealing washer. The connecting element is disposed over an edge of a first of the at least two corrugated sheets so that the edge of the first corrugated sheet is inserted between said first and said second portions of said connecting element, so that the edge is located next to and parallel to said folding line. The second of the at least two corrugated sheets is disposed over the first of the corrugated sheets so that a peak of a corrugation of the second corrugated sheet closest to an edge of the second corrugated sheet is placed and overlaps a peak of a corrugation of the first corrugated sheet closest to the edge having said connecting element disposed at, and wherein said screw is inserted through said sealing washer and through coaxial holes drilled in said second corrugated sheet and said first corrugated sheet and is screwed in said threaded hole of said connecting means, thereby firmly attaching said first corrugated sheet to said second corrugated sheet and presses said sealing washer to provide liquid tight sealing between a head of said screw and the top of said second corrugated sheet.

A method for connecting two corrugated sheets to each other is disclosed comprising placing at least one fastening element over an edge of a first corrugated sheet; placing a second corrugated sheet over the first corrugated sheet so that a peak of a corrugation of the second corrugated sheet closest to an edge of the second corrugated sheet is placed and overlaps a peak of a corrugation of the first corrugated sheet closest to the edge having said connecting element disposed at; forming concentric holes through said first and said second corrugated sheets so that the center of said holes coincides with a threaded hole made in said connecting means; inserting a fastening screw through a sealing washer and through said concentric holes; and fastening said fastening screw by threading it in said threaded hole, to firmly fasten said first corrugated sheet to said second corrugated sheet and to provide liquid tight sealing between a head of said screw and the top of said second corrugated sheet.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIGS. 3A and 3B top isometric view and bottom isometric view, respectively, of exemplary connecting elements according to some embodiments of the invention;

Figure 1A:
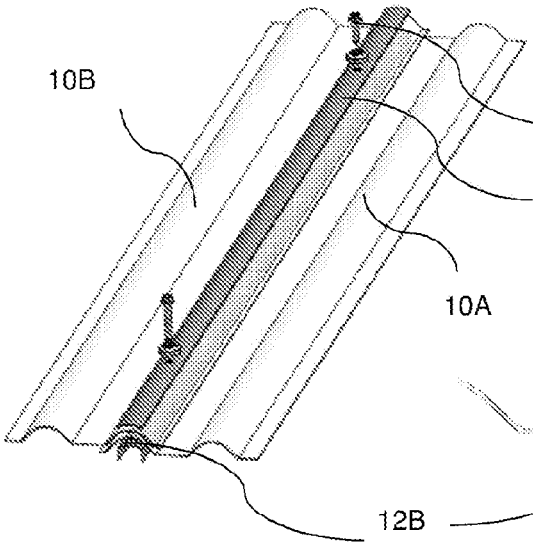
FIG. 1A PRIOR ART
FIGS. 1A and 1B are isometric and side views respectively of elongated connecting elements for connecting corrugated sheets as known in the art.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Some aspects of the present invention are related to a connecting element for connecting corrugated plastic sheets. The connecting element may connected corrugated plastic sheets such that a good sealing is formed between each two connected sheets. Connecting two corrugated sheets using a connecting element according to some embodiments of the invention may require the work of a single worker, using simple assembling techniques.

Figure 1B:
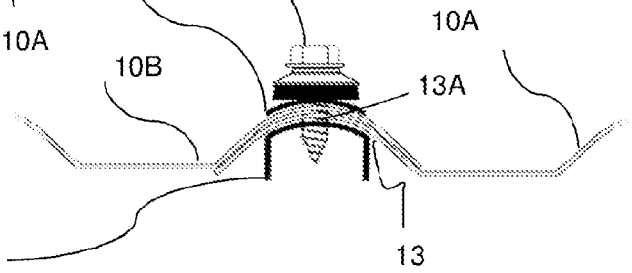
FIG. 1B PRIOR ART
Figure 1C:
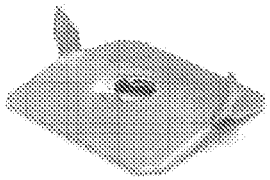
FIG. 1C PRIOR ART
FIG. 1C is an exemplary illustration of self-grip lap fastener with pair of claws, as is known in the art.
Figure 1D:
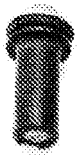
FIG. 1D PRIOR ART
FIGS. 1D and 1E are exemplary illustrations of rubber stitching fastener with internal threading in loose position and in tightened position as is known in the art.
Figure 1E:
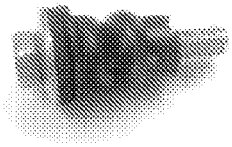
FIG. 1E PRIOR ART

In some embodiments of the present invention, a plurality of short connecting elements may be assembled along the overlapping locations between two overlapping corrugated sheets. Substantially short and identical connecting elements may be assembled at every building where corrugated sheets having substantially identical profile are used, for example, omega profile or trapezoidal profile, regardless of the building's or the sheets dimensions. Such sort of connecting elements may be produced in mass production, thus lowering their relative cost to less than customized size connecting elongated elements, for example as depicted in FIGS. 1A, 1B.

Figure 2A:
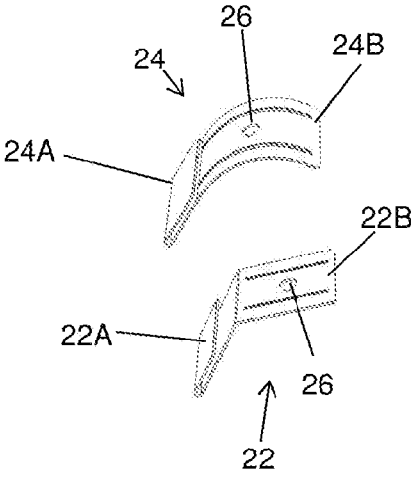
FIGS. 2A and 2B are top view image and side view image of two exemplary connecting elements according to some embodiments of the invention.
Figure 2B:
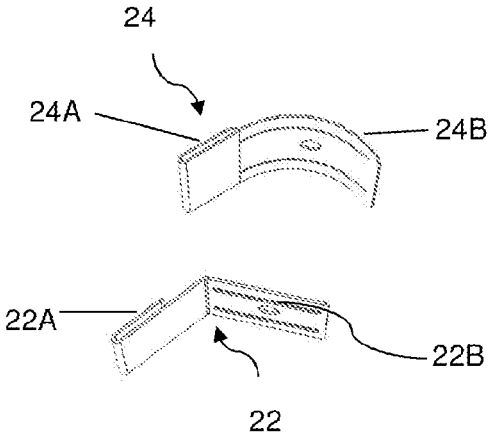

Reference is now made to FIGS. 2A and 2B, which are a top view and an isometric side view, respectively, of two exemplary connecting elements according to some embodiments of the invention. Connecting elements 22 and 24 may be configured to connect two different corrugated sheets. Element 22 may be configured to connect corrugated sheet having a trapezoidal corrugation profile. Element 24 may be configured to connect corrugated sheet having a wavy profile (i.e., a wave shaped profile). Elements 22 and 24 may be made from a thin metal sheet, for example, a steel sheet, a stainless steel sheet, an aluminum alloy sheet or the like. The metal sheet from which elements 22 and 24 may be made may have a thickness ranging from less than 1 mm to 2 mm or more, as may be dictated by variables such as the thickness of the corrugated sheets, the required fastening strength and the like.

Figure 3A:
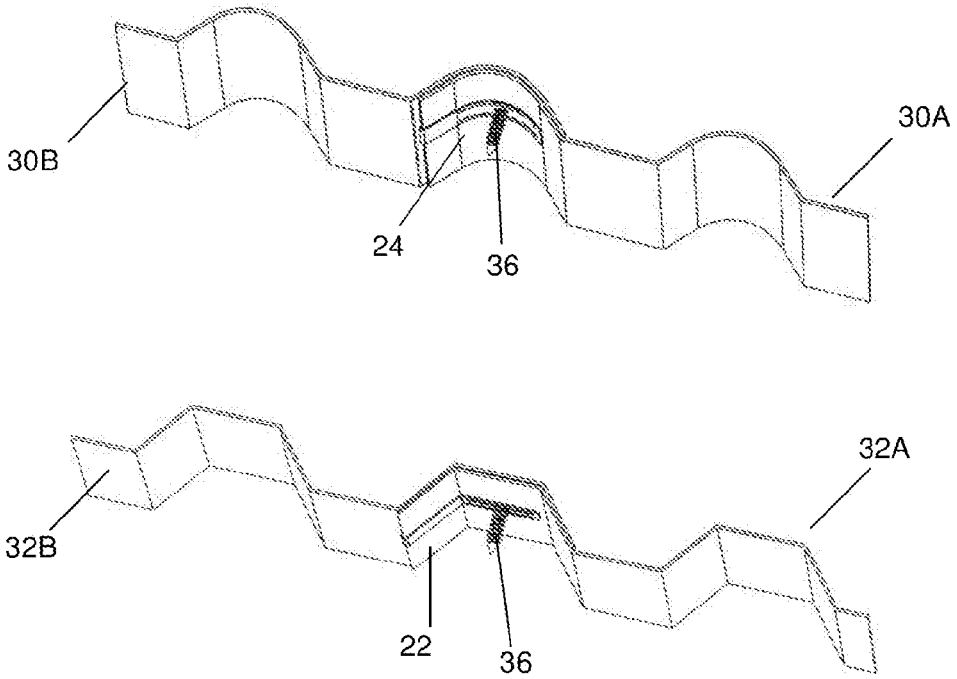
Figure 3B:
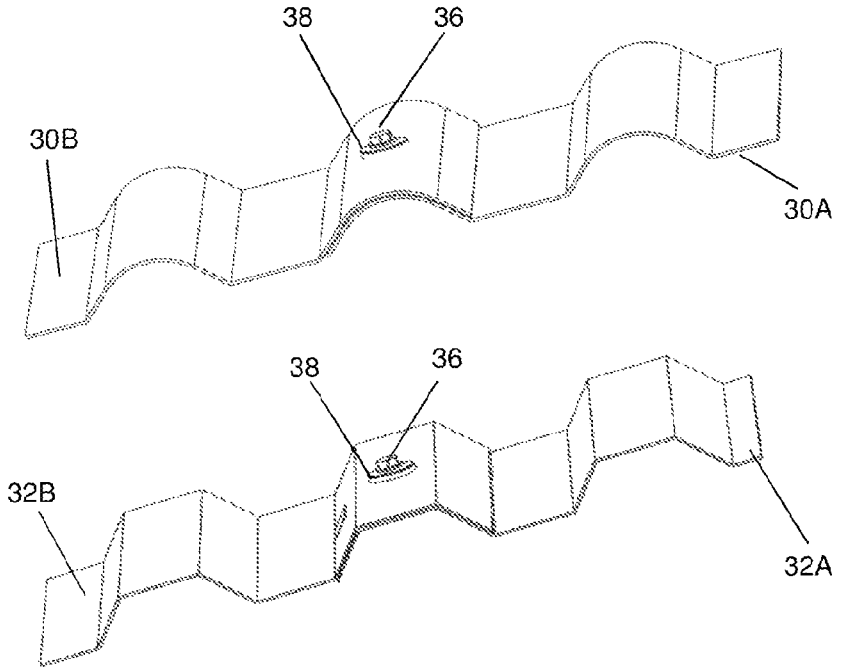

Each of elements 22 and 24 may include a folded portion 22A, 24A, respectively, and a shaped portion 22B, 24B, respectively. Each of elements 22 and 24 may further include at least one threaded hole 26 for connecting the elements to the sheets using any type of fastening screw that is configured to fasten sheets together. Folded portions 22A. 24A may be folded such that an edge of the corrugated plastic sheet may be inserted in between folded portion 22A, 24A and the shaped portion 22B, 24B, respectively, and the threaded hole 26 may be positioned against a peak of the corrugated profile, as illustrated in FIGS. 3A and 3B. The thickness of the metal sheet forming elements 22 and 24 and in particular folded portions 22A and 24B may be such that gap 4000A (FIG. 4) that may be formed between two overlapping ends of corrugated sheets when the edge of a first corrugated sheet (e.g., sheet 32A illustrated in FIG. 4) inserted into the folded portion and a second corrugated sheet (e.g., sheets 32B illustrated in FIG. 4) may be kept minimal allowing good sealing between the two connected corrugated sheets, for example due to tight fastening of a fastening means. This feature is widely discussed with respect to FIG. 4.

Shaped portions 22B and 24B may have substantially the same profile shape as the sheet profile to which elements 22 or 24 are made to connect. For example, portion 22B may have the dimensions, proportions and angles to fit to a trapezoidal profile sheet when connected to/snapped on it, and portion 24B may have the curvature shape suitable to be fit to a wavy profile sheet. Portions 22B and 22B may include threaded hole 26.

Reference is now made to FIGS. 3A and 3B, which are a bottom isometric view and a top isometric view, respectively, of exemplary connecting elements 22, 24 connecting exemplary corrugated sheets according to some embodiments of the invention. Corrugated sheets 30A and 30B may have a wavy profile and may be connected using connecting element 24. Corrugated sheets 32A and 32B may have a trapezoidal profile and may be connected using connecting element 22. The edge of the lower corrugated sheet (e.g., sheets 30A and 32A) may be inserted between the folded portion and the formed portion of the respective connecting element, and the upper corrugated sheet (e.g., sheets 30B and 32 B) may be placed on top of the first, bottom, sheet (30A, 32A) at least partially overleaping the bottom sheet. A fastening screw 36 may be screwed from the top side of top sheet 30B, 32B through bottom sheet 30A, 32A, respectively, and be threaded into threaded hole 26, thus fixing and tightening together the bottom corrugated sheet to the upper corrugated sheet. Gasket 38 may be used between screw 36 head and the top side of the top sheet to achieve better sealing of the hole made for fastening screw 36 in the upper sheet.

Figure 3C:
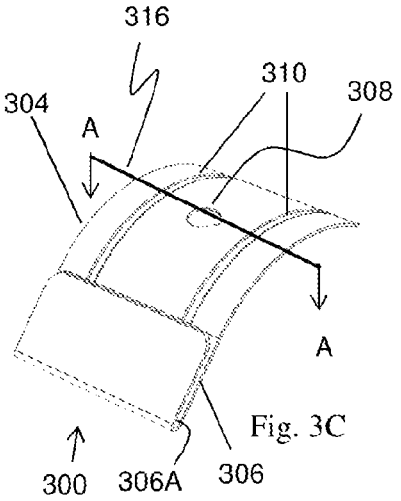
FIGS. 3C and 3D depicting connecting elements with strengthening submergences in isometric views, according to embodiments of the present invention.
Figure 3D:
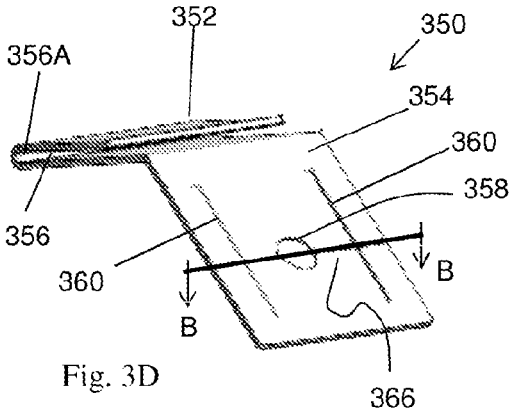

Reference is made to FIGS. 3C and 3D depicting connecting elements 300, 350 with strengthening submergences 310, 360 in isometric views, according to embodiments of the present invention. Connecting element 300 is formed as a round profile shaped thin clip and connecting element 350 is formed as an angular shaped thin clip. Connecting elements 300, 350 may be similar to connecting elements 22 and 24, respectively, in general. Connecting elements 300, 350 may be made of a flat material having high resistance to bending such as thin metal sheet. Connecting elements 300, 350 are made as folded clips with a first, folded part 302, 352 and second, shaped part 304, 354 wherein the first, folded part 302, 352 is shorter than the second, shaped part 304, 354 and they are respectively substantially parallel to each other where they are overlapping. The folding of folded part 302, 352 with respect to shaped part 304, 354 leaves a thin gap 306, 356 between the parallel and overlapping parts. Thin gap 306, 356 may be used for inserting an edge of a corrugated board into it so that the edge of the corrugated board substantially reaches to the deep end 306A, 356A of gap 306, 356 and the concaved side of the corrugated board (not shown here) overlaps the second, shaped part 304, 354. Connecting element 300, 350 may have made, in a first portion of the second, shaped part 304, 354 that does not overlap the first, folded part 302, 352, a hole 308, 358 formed as a thread of a nut adapted to receive nut 450 (FIG. 3F). The first portion of the second, shaped part 304, 354 may also have formed, in it, at least one submergence 310, 360 that is made to provide additional resistance to undesired folding of second part 304, 354 about imaginary line 316, 366 running through hole 308, 358 perpendicular to the longitudinal dimension of submergence 310, 360 and crossing said submergence.

Figure 3E:
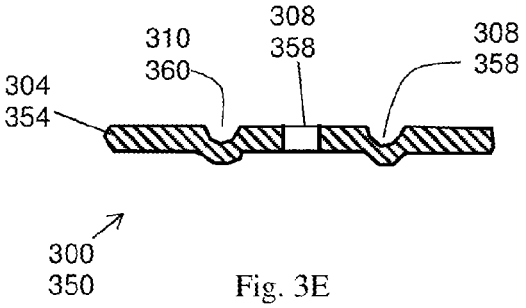
FIG. 3E presenting typical cross section made in a connecting element, according to embodiments of the present invention.
Figure 3F:
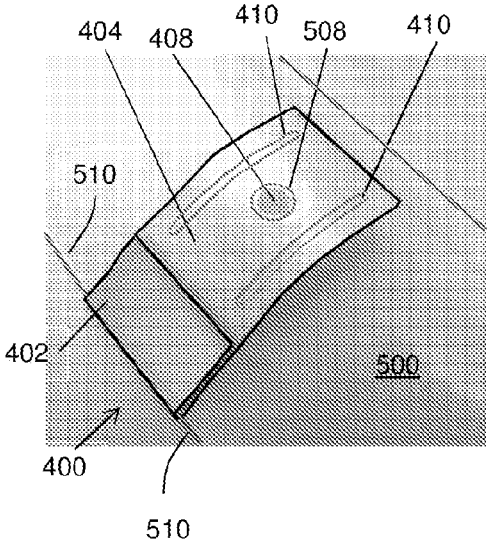
FIGS. 3F and 3G depicting use of connecting element for the connection of two corrugated boards, according to embodiments of the present invention.

Reference is made now also to FIG. 3E presenting typical cross section form made in connecting element 300, 350 along line 316, 366 according to embodiments of the present invention. Submergences 310, 360 may extend along most of the longitudinal dimension of second, shaped part 304, 354 of connecting element 300, 350.

Figure 3G:
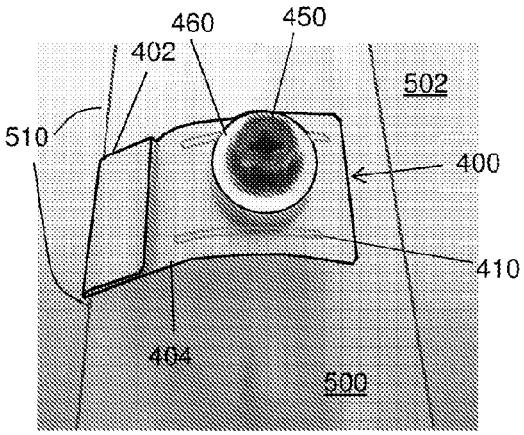

Reference is made now to FIGS. 3F and 3G depicting use of connecting element 400 for the connection of two corrugated boards 500 and 502, according to embodiments of the present invention. Connecting element 400 may be placed on an edge 510 of corrugated board 500 so that edge 510 is inserted to the deep end of the folding of connecting element 400, first, folded part 402 of connecting element 400 is placed on the side seen upper in FIG. 3F and the second, shaped part 404 is placed adjacent to the part seen lower of corrugated board 500. Hole 508 may be cut in board 500 matching hole 408 of connecting element 408. At this stage an adjacent corrugated board 502 may be placed so that its left most corrugation overlaps the right most corrugation of board 500 and a hole (not shown) may be made in board 502 that matches hole 508 of board 500. Now, bolt 450 may be inserted through washer 460, through the whole in board 504 and through the hole in board 502 and be screwed into threaded hole 408, and be tightened to a desired tension. Submergences 410 may provide extended resistance to unfolding of the corrugation of board 500, 502.

Figure 4:
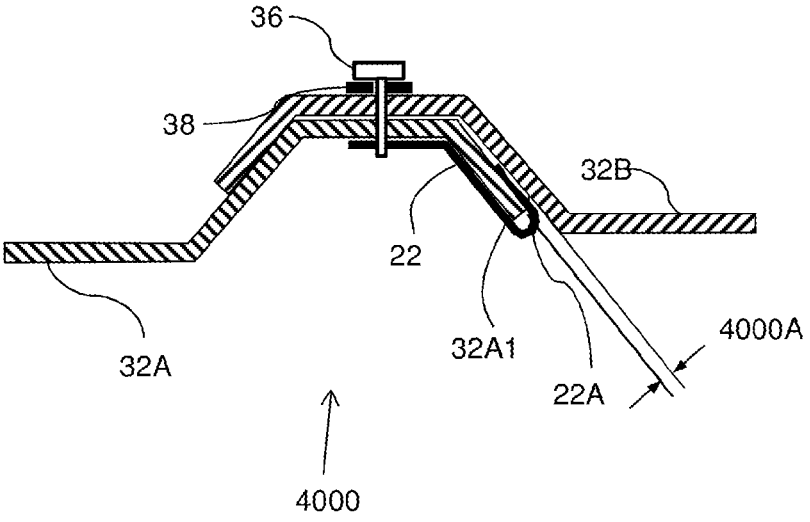
FIG. 4 is an illustration of exemplary connecting elements connecting exemplary corrugated sheets according to some embodiments of the invention.

Reference is made to FIG. 4, which is a schematic side view illustration of exemplary arrangement 4000 in which connecting element 22 connects corrugated sheets 32A and 32B according to some embodiments of the invention. The edge 32A1 of first sheet 32A is inserted into the folding of folded portion 22A of element 22. Sheet 32A and element 22 are attached to second sheet 32B such that a gap 4000A may be formed between first sheet 32A and second sheet 32B locally around connecting element 22 due to the presence of first, folded part 22A between corrugated sheet 32A and corrugated sheet 32B. When fastening screw 36 is turned and screwed into the threaded hole (such as threaded hole 26 of FIG. 2A) to tighten gasket 38, first corrugated sheet 32B and second corrugated sheet 32A together, the gap 4000A may be reduced to an amount that may ensure good sealing between the first and second corrugated sheets due to the tightening by screw 36 and element 22. The thickness of the first, folded portion 22A may be thin enough so that the at least one of the first or second corrugated sheets may slightly deform and may at least partially close the gap.

Fastening corrugated sheets using fastening elements according to some embodiments of the present invention may be disposed along the peak line of the profile every distance that fits the sealing and strength of connection that may be required. Use of fastening elements according to some embodiments of the present invention may easily allow fastening curved planes of roofs even when the curvature line extends, for example, along the peaks of the corrugations, or parallel to them, since the fastening is made locally at the point where it was applied, leaving the line between two consecutive fastening locations flexible as much as the flexibility of the corrugated sheets.

Figure 5:
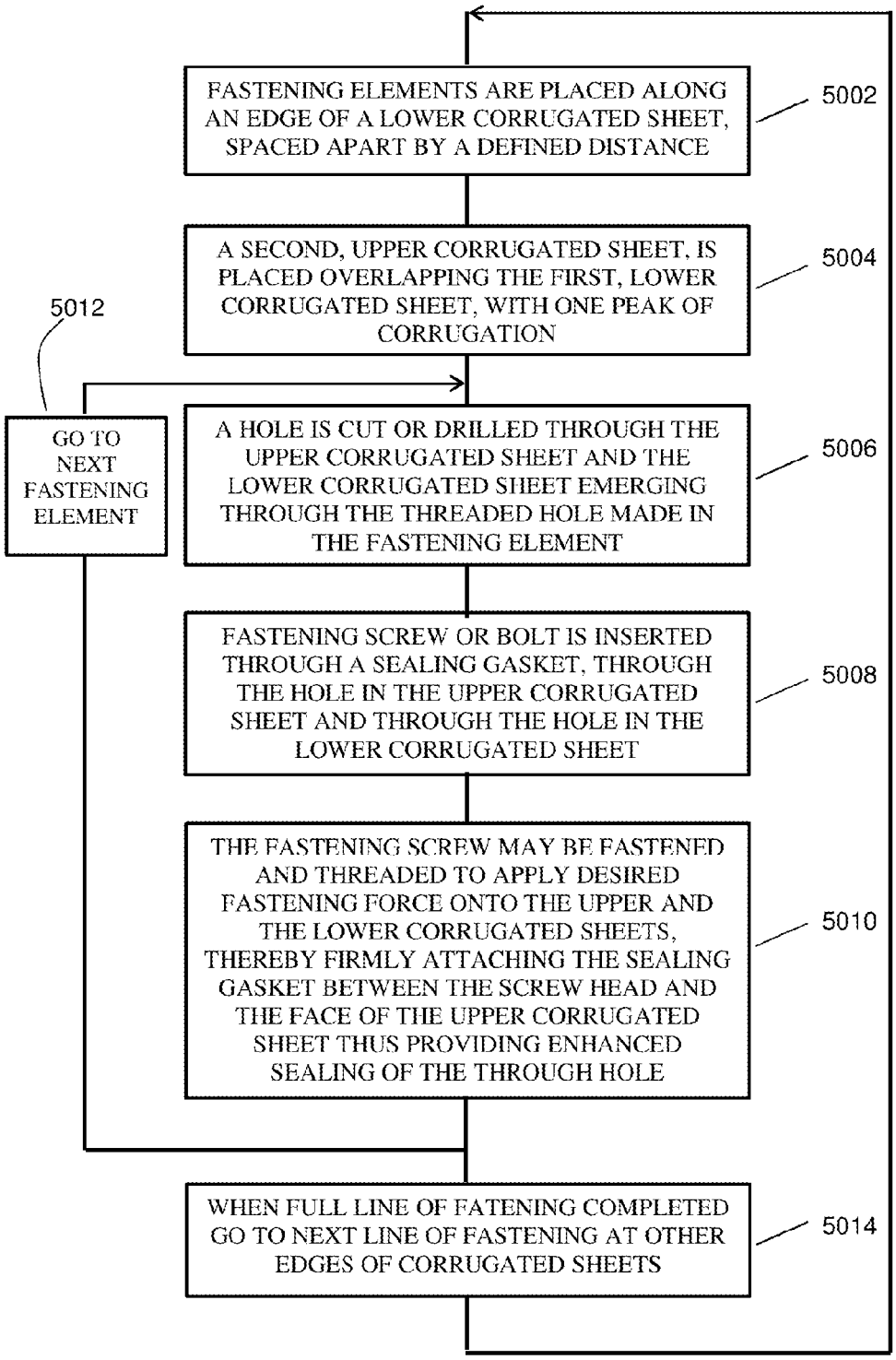
FIG. 5 is a flow diagram depicting steps for applying fastening elements to corrugated sheets according to embodiments of the present invention.

As seen in the referred drawings, installation of corrugated covers using fastening elements according to some embodiments of the present invention may be done by a single worker who may locate fastening elements along the edge of the lower sheet spaced apart at a desired distance, then locate the top sheet on the bottom sheet with the desired overlap, then drill-through the fastening bolt through the top sheet aiming into the threaded hole in the fastening element.

reference is made now to FIG. 5, which is a flow diagram depicting steps for applying fastening elements to corrugated sheets according to embodiments of the present invention. Fastening elements formed according to embodiments of the present invention may be placed along an edge of a lower corrugated sheet, spaced apart by a defined distance (block 5002). The fastening elements should preferably be disposed so that the folding line between the first, folded part and the second, shaped part is placed as close as possible to the edge of the lower corrugated sheet. A second, upper corrugated sheet may be placed overlapping the first, lower corrugated sheet with one peak of corrugation (block 5004). A hole may be cut or drilled through the upper corrugated sheet and the lower corrugated sheet emerging through the threaded hole made in the fastening element (block 5006). A fastening screw or bolt may be inserted through a sealing gasket, through the hole in the upper corrugated sheet and through the hole in the lower corrugated sheet (block 5008). The fastening screw may be fastened and threaded to apply desired fastening force onto the upper and the lower corrugated sheets, thereby firmly attaching the sealing gasket between the screw head and the face of the upper corrugated sheet thus providing enhanced sealing of the through hole (block 5010). The operations in blocks 5002 to 5010 may be repeated (block 5012) until the desired number of fastening element has been applied and tightened.

When fastening elements are installed along a full length of the connection of two adjacent corrugated sheets, fastening of another, third, corrugated sheet to, for example the second corrugated sheet, may begin (block 5014.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. An assembly of corrugated sheets connected to each other comprising:

at least two corrugated sheets having similar profile of corrugations; and at least one connecting element comprising:

a first portion; and a second portion longer than the first portion, the first and second portions are folded with respect each other along a folding line so that the first portion is substantially parallel to and overlapping a first part of the second portion, the second portion is formed according to a profile of said corrugated sheet;

wherein a threaded hole is formed in said second portion at a second part not parallel to said first portion, a fastening screw for each of said at least one connecting element; and a sealing washer;

wherein said connecting element is disposed over an edge of a first of said at least two corrugated sheets so that the edge of the first corrugated sheet is inserted between said first and said second portions of said connecting element, so that the edge is located next to and parallel to said folding line, wherein a second of said at least two corrugated sheets is disposed over the first of said corrugated sheets so that a peak of a corrugation of the second corrugated sheet closest to an edge of the second corrugated sheet is placed over and overlaps a peak of a corrugation of the first corrugated sheet closest to the edge over which said connecting element is disposed, wherein said screw is inserted through said sealing washer and through coaxial holes drilled in said second corrugated sheet and said first corrugated sheet and is screwed in said threaded hole of said connecting means, thereby firmly attaching said first corrugated sheet to said second corrugated sheet and presses said sealing washer to provide liquid tight sealing between a head of said screw and the top of said second corrugated sheet.

2. The assembly of corrugated sheets of claim 1 wherein said connecting element further comprising at least one strengthening submergence formed in said second part of said second portion.

3. The assembly of corrugated sheets of claim 2 wherein said second part of said connecting means is formed to have a wavy profile.

4. The assembly of corrugated sheets of claim 2 wherein said second part of said connecting means is formed to have an angular profile.

* * * * *